United States Patent [19]

Thompson et al.

[11] 4,344,464

[45] Aug. 17, 1982

[54] ENDLESS FORMING FABRICS WITH BI-CRIMP CHARACTERISTICS

[75] Inventors: Charles E. Thompson, Guilderland; Samuel H. Herring, Rensselaer, both of N.Y.

[73] Assignee: Huyck Corporation, Wake Forest, N.C.

[21] Appl. No.: 168,942

[22] Filed: Jul. 11, 1980

[51] Int. Cl.[3] ..... D21F 1/10; D03D 15/00

[52] U.S. Cl. ..... 139/383 A; 139/425 A; 162/DIG. 1

[58] Field of Search ..... 139/383 A, 425 A, 408–413; 162/DIG. 1, 348, 358, 359; 34/95, 116, 123

[56] References Cited

U.S. PATENT DOCUMENTS

| | | | |
|---|---|---|---|
| 3,885,602 | 5/1975 | Slaughter | 139/425 A |
| 3,885,603 | 5/1975 | Slaughter | 139/425 A |
| 4,086,941 | 5/1978 | Thompson | 139/383 A |
| 4,149,571 | 4/1979 | Burroughs | 139/383 A |

FOREIGN PATENT DOCUMENTS

| | | | |
|---|---|---|---|
| 454092 | 12/1927 | Fed. Rep. of Germany | 139/383 A |
| 731243 | 2/1943 | Fed. Rep. of Germany | 139/383 A |
| 1011897 | 4/1952 | France | 139/383 A |
| 297738 | 4/1971 | U.S.S.R. | 139/383 A |

*Primary Examiner*—James Kee Chi

*Attorney, Agent, or Firm*—Kenway & Jenney

[57] ABSTRACT

A double layer endless woven forming fabric having a sheet surface fabric structure comprising relatively fine warp and filling yarns exhibiting substantially uniform crimp in both directions, and a relatively coarse wear side fabric structure having woven warp and filling yarns exhibiting crimp predominately in the warp yarns, the layers being joined by interlacing the warp yarns of the wear surface fabric structure with the filling yarns of the sheet surface fabric structure.

6 Claims, 3 Drawing Figures

ENDLESS FORMING FABRICS WITH BI-CRIMP CHARACTERISTICS

This invention relates to papermaking fabrics and more particularly to endless woven synthetic fabrics for use primarily in the forming area of papermaking machines. While the invention is particularly applicable to forming fabrics for the production of high quality rotogravure paper, it is applicable to all types of forming fabrics to enhance their sheet forming characteristics and stability.

BACKGROUND OF THE INVENTION

Forming fabrics for the production of quality paper originally comprised a woven metal mesh, such as phosphor bronze, but for a number of years the metal mesh has been replaced by synthetic textile materials, and forming fabrics woven from synthetic yarns are in widespread use. The ever increasing demand for better quality paper has traditionally resulted in a reduction of the diameters of the yarns with a corresponding increase in the number of yarns. While simply increasing the number of picks will improve fiber support, a point is reached where drainage is reduced beyond an acceptable level. As a result, smaller diameter yarns must be used to maintain good drainage while increasing the number of fiber support points. While this has resulted in improved paper quality, the stretch resistance of the fabrics has gone down exponentially with a reduction of yarn diameter, and if the mesh becomes too fine, the fabric will be weakened and its wear resistance materially reduced.

In addition to the foregoing, a fabric used in the forming area of a papermaking machine must be dimensionally stable in both the machine and cross-machine directions of the fabric. Instability in the machine direction is reflected as stretch, whereas instability in the cross-machine direction may be seen as fabric width contraction at the high tension side of the couch roll or drive roll. Instability in either direction resulting in a dimensional change greater than 1% will generally result in the early failure of the fabric. In fact, some papermaking machines have a machine direction stretch tolerance as low as 0.25%.

Cross-machine instability is a result of an interchange of crimp from the machine direction yarns into the cross-machine direction yarns brought about by tension developed in the machine direction yarns when the fabric is in use. As the machine direction yarns become straighter, the fabric loop becomes longer, and as the crimp in the cross-machine direction yarns is increased, the fabric contracts and becomes narrower. Fabric contraction of any amount is undesirable and if in excess of 0.3% is generally undesirable. Typically, an endless fabric is woven with some degree of crimp in the machine direction. The fabric is then heat set in the finishing process while being overstretched in the machine direction. This overstretching and heat setting is to remove as much crimp as practical from the machine direction yarns and thereby maximize stability, i.e., minimize stretch and contraction on the papermaking machine. At best, such fabrics are a compromise both with respect to dimentional stability and wear characteristics.

The approach taken by the industry towards solving the problems encountered with synthetic forming fabrics has been to go to the use of duplex or double layer fabrics. However, in a duplex fabric, such as that taught in U.S. Pat. No. 3,915,202, Oct. 28, 1975, any yarns undulating through both surfaces of the fabric must serve both as a sheet forming yarn (preferably fine), as well as a wear yarn (preferably coarse). This results in a compromise with respect to both sheet quality and wear, and despite efforts to enhance fabric stability by varing the modulus of elasticity of the yarns, the majority of crimp remains in the machine direction yarns.

It has also been proposed in Japanese Patent No. 40 15842, dated July 22, 1965, to join a conventional 2/1 twill fabric with a plain weave substrate, the two fabrics being joined either by bonding them together utilizing a bonding agent, or by utilizing selected yarns of the 2/1 twill sheet forming fabric for stitching. Bonded fabrics are not practical, and where stitching is employed, the fine yarns dropped out of the sheet forming fabric for stitching purposes results in holes in the fiber support system. In addition, if the crimp in the machine direction yarns of the sheet forming surface is retained, the fabric stretches; and if the crimp is reduced, inadequate sheet support and wire marking is encountered.

In contrast to the foregoing, the present invention relates to an improved double layer fabric having two functional sides, the pulp receiving or sheet forming side consisting of bi-crimped yarns selected to be conducive to improve sheet characteristics, and a machine or wear side consisting of coarser yarns woven and interlaced with the sheet forming side in a manner to enhance stability, particularly in the machine direction, and also the wear characteristics of the fabric.

SUMMARY OF THE INVENTION

The double layer fabric of the present invention is woven endless utilizing two fabric structures-a first fabric structure for the sheet side and a second fabric structure for the wear side. Both structures utilize warp yarns (which are in the cross-machine direction in an endless fabric) and filling yarns (which are in the machine direction in an endless fabric). In this connection, it should be explained that the term "machine direction" refers to the direction of travel of the sheet being formed on the papermaking machine and hence the direction of travel of the forming fabric. Where a fabric is woven flat and spliced together to form an endless loop, the warp yarns extend in the machine direction and the filling yarns in a cross-machine direction. However, where the fabric is woven endless, as in the case of the fabrics of the present invention, the filling yarns extend in the machine direction on the papermaking machine, and the warp yarns extend in the cross-machine direction.

In accordance with the invention, the sheet side of the fabric normally utilizes relatively fine yarns with a high pick count for both the machine and cross-machine direction yarns. The fine yarns are, however, of two different moduli of elasticity in order to obtain a smooth bi-crimp surface. It has been found that if machine and cross-machine direction yarns of comparable size and modulus are used during weaving, the crimp of the fabric is mainly in the cross-machine direction yarns. To overcome this situation and obtain substantially uniform crimp in both directions for better sheet support, machine direction yarns are used which have a lower modulus and yield point than the cross-machine direction yarns. Preferably, the machine direction yarns will have a 10–40% lower modulus than the cross-machine direction yarns and an elongation in the range of from 28–80% to prevent them from becoming load-bearing yarns while allowing them to achieve a fully bi-crimped condition that will not be removed in finishing. In fact, crimp is not removed from the machine direction yarns in finishing, but rather tends to increase due to a lower shrinkage force relationship to the cross-machine direction yarns in the sheet forming fabric.

The other functional side of the fabric comprises a fabric structure having coarse yarns which impart enhanced wear resistance in the cross-machine direction and enhanced stretch resistance in the machine direction. These yarns are woven with substantially all of the crimp in the cross-machine direction yarns. The crimp of the cross-machine direction yarns in the wear surface fabric protects the load bearing machine direction yarns, which are essentially straight, and keeps them away from the wear surface, the cross-machine direction yarns taking substantially all the machine wear effectively for the life of the fabric. The machine direction yarns of the base fabric are preferably woven with more than one pick in the shed, thus reducing the number of cross-machine direction yarn interlacings and increasing the number of load-bearing yarns to thereby improve stretch resistance and wear resistance. The characteristics of the weave act to maintain the load-bearing machine direction yarns in an essentially straight, non-crimp configuration, thereby decreasing machine direction stretch.

The two fabric layers are joined together by interlacing the cross-machine direction yarns of the wear surface fabric with the low modulus filling yarns of the sheet surface fabric. With this arrangement, the coarse yarns do not interfere with the integrity of the sheet surface fabric due to the ability of the low modulus filling yarns of the sheet surface fabric to yield at the points where interlacing occurs. This yielding at the interlacing points allows the coarse cross-machine direction yarns to sink within the sheet forming plane of the sheet surface fabric, thereby adding to fiber support without disturbing the sheet forming surface in a manner which would mark the sheet.

The double fabric of the present invention provides a composite forming fabric having a bi-crimp nature which is unobtainable by conventional endless weaving technology. If, for example, an endless ½ or 2/1 twill is woven with yarns which provide a smooth uniform bi-crimp surface, the yarns which possess the necessary properties to crimp in the machine direction do not provide the necessary machine direction stretch resistance for forming area uses where machine direction stretch resistance is essential, as in a Fourdrinier machine. However, in accordance with the invention, by combining a bi-crimp sheet forming fabric with a coarse yarn wear fabric, the necessary stretch resistance and wear characteristics can be achieved. The terms "bi-crimped condition", "bi-crimp nature", etc. refer to the fact that both the machine direction yarns and the cross-machine direction yarns define knuckles having significant crimp amplitudes. See, e.g. U.S. Pat. No. 4,149,571.

DETAILED DESCRIPTION

Figure 1:
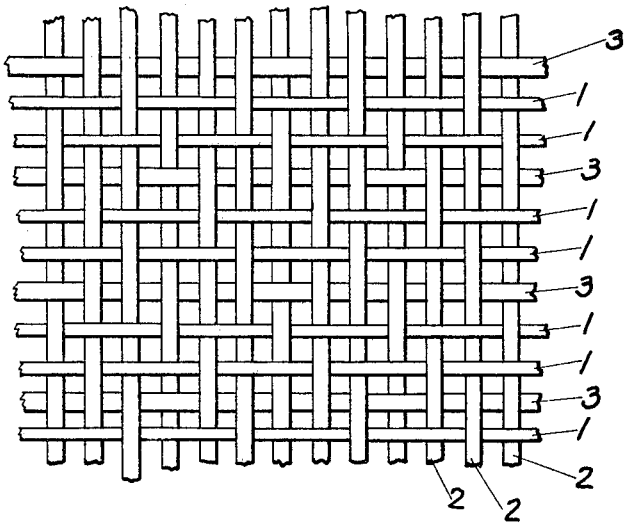
FIG. 1 is an enlarged fragmentary plan view of a section of an exemplary fabric woven in accordance with the present invention illustrating the surface characteristic of the fine or sheet forming side of the composite fabric.

Referring first to FIG. 1, the fine side of the composite fabric illustrated comprises cross-machine direction warp yarns 1 and machine direction filling yarns 2 woven in a ½ machine direction twill pattern. The yarns 1 and 2 are of different moduli and yield point, the machine direction yarns 2 having a modulus which is from 10–40% lower than the modulus of the cross-machine direction yarns 1 and an elongation of from 28–80%. The yarns 1 and 2 are selected to provide substantially uniform crimp in both sets of yarns to thereby provide the desired smooth surface to support the paper being formed with reduced marking.

Figure 2:
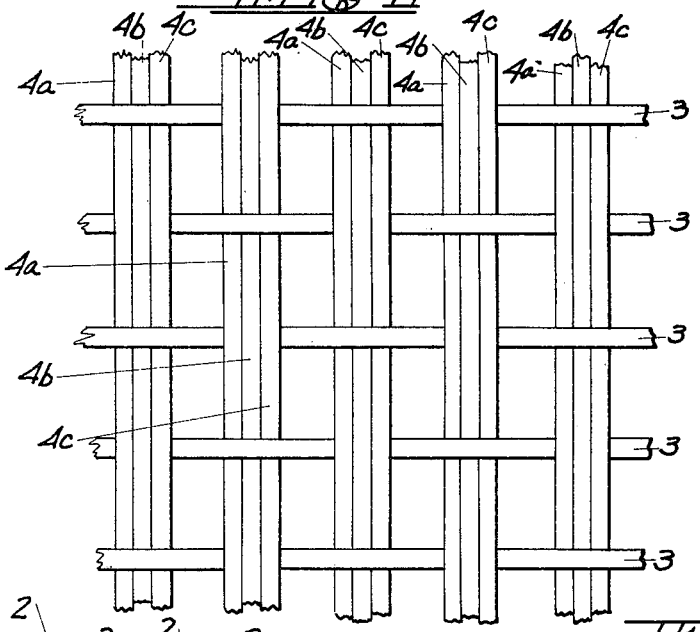
FIG. 2 is an enlarged fragmentary sectional view of a section of the composite fabric taken from the wear or coarse side of the fabric.

The reverse side of the composite fabric is seen in FIG. 2. This is the wear side of the fabric and in the embodiment illustrated comprises relatively coarse cross-machine direction yarns 3 and machine direction yarns 4 woven in a rib weave. The machine direction yarns 4 are woven with three picks in a shed, indicated at 4*a*, 4*b* and 4*c*. The cross-machine direction yarns 3 have substantially all of the crimp and act to maintain the load-bearing machine direction yarns 4 in an essentially straight, non-crimped configuration which decreases machine direction stretch.

Figure 3:
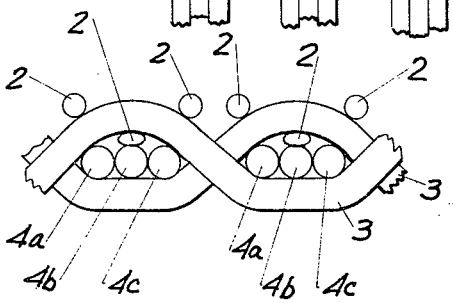
FIG. 3 is an enlarged fragmentary sectional view of the composite fabric showing the coarse cross-machine direction wear yarns of the wear side fabric interlaced with the low modulus machine direction filling yarns of the sheet forming fabric.

The two functional planes of the fabric, i.e., the fine fabric structure and the coarse fabric structure, are stitched together during weaving by the interlacing of the coarse cross-machine direction yarns 3 with the low modulus machine direction yarns 2 of the sheet forming side of the double fabric, as will be seen in FIGS. 1 and 3. The coarse yarns 3 do not interfere with the surface characteristics of the sheet forming side of the fabric due to the ability of the low modulus machine direction yarns 2 to yield. This yielding at the interlacing points allows the coarse cross-machine direction yarns 3 to sink within the sheet forming plane defined by the overlying machine direction yarns 2, as will be evident from FIG. 3, thereby enhancing fiber support without disturbing the surface characteristics of the sheet side yarns 1 and 2.

While the ½ machine direction twill pattern described above is particularly suited for the sheet forming side of a rotogravure fabric, other weave patterns may be employed, including a 1/1 plain weave, a 2/2 twill, a broken twill, sateens and other papermaking patterns known to the worker in the art. Similarly, the wear side weave pattern may comprise a plain weave variant, a ½ twill duplex, a three harness twill or a three harness duplex. Basically the weave patterns chosen will be determined by the grade of fabric being made, an essential consideration being the provision of substantially uniform bi-crimp in the sheet forming fabric structure.

The size (diameter) of the yarns also will be determined by the demands of the grade being made. In fabrics for fine papers and printing grades, fine yarns will be used for the sheet forming surface while coarser yarns are used for the wear surface. However, there are situations, such as in liner board applications, wherein the sheet forming surface may be relatively coarse. The need for bi-crimp in the sheet forming surface nonetheless remains and relatively low modulus yarns are used in the machine direction to achieve the desired bi-crimp configuration.

Exemplary yarns used in weaving fabrics for fine paper applications according to the invention are as follows:

| | Diameter (mm) | Yarn's Initial Modulus (G/den.) | Breaking % Elongation |
|---|---|---|---|
| CDM sheet surface yarns | 0.15 | 99 | 17 |
| MD sheet surface yarns | 0.13 | 74 | 60 |
| | 0.15 | 74 | 60 |
| CDM wear surface yarns | 0.20 | 95 | 17 |
| MD wear surface yarns | 0.19 | 110 | 15 |
| | 0.21 | 105 | 15 |

In an exemplary double layer fabric of the type illustrated in the drawings, the sheet surface is woven using 0.15 mm yarns having 65 ends per inch in the cross-machine direction and 0.13 mm yarns having 83 picks per inch in the machine direction, the wear surface fabric being woven from 0.20 mm yarns having 32.5 ends per inch in the cross-machine direction and 0.21 mm yarns having 83 picks per inch in the machine direction.

In addition to the double layer fabric being formed from two single layer fabric structures, the fabric may be from one single layer fabric joined with a duplex fabric, i.e., a single layer fabric having sets of either machine direction or cross-machine direction yarns in more than one plane, or the fabric may comprise two duplex fabrics. In any event, the fabric layers will be stitched together by interlacing the machine direction yarns of the wear surface fabric structure with the cross-machine direction yarns of the sheet surface fabric structure.

What is claimed is:

1. A double layer endless woven papermaking fabric having two functional sides, the first layer comprising a sheet surface structure having non-load-bearing machine direction and cross-machine direction yarns woven with substantially uniform crimp in both directions, the second layer of the fabric comprising a relatively coarse wear surface fabric structure having yarns larger than said yarns of said first layer, said larger yarns including woven load-bearing machine direction yarns and cross-machine direction yarns, said non-load-bearing machine direction yarns of said sheet surface fabric structure having elongation greater than the elongation of the machine direction yarns in the wear surface fabric structure, the two structures being joined together by interlacing the cross-machine direction yarns of the wear surface fabric structure with the machine yarns of the sheet surface fabric structure, whereby to provide a double layer fabric characterized by a sheet side exhibiting bi-crimp characteristics and a machine side exhibiting enhanced wear characteristics and stretch resistance.

2. The double layer papermaking fabric claimed in claim 1 wherein the machine direction yarns of the sheet surface fabric structure have a 10–40% lower modulus of elasticity than the cross-machine direction yarns of the sheet surface fabric structure.

3. The double layer papermaking fabric claimed in claim 2 wherein the machine direction yarns of the sheet surface fabric structure have an elongation of from 28 to 80%.

4. The double layer papermaking fabric claimed in claim 1 wherein crimp in the coarse wear surface fabric structure is essentially confined to the cross-machine direction yarns, whereby to maintain the alignment of the machine direction yarns in the wear side fabric yarns and decrease machine direction stretch.

5. The double layer papermaking fabric claimed in claim 4 wherein the yarns in the wear surface fabric structure are of larger diameter than the yarns in the sheet side fabric structure.

6. The double layer papermaking fabric claimed in claim 1 wherein said non-load-bearing machine direction yarns have an elongation greater than the elongation of the cross-machine direction yarns of said sheet surface fabric structure.

* * * * *